US010336505B2

(12) United States Patent
Moore

(10) Patent No.: US 10,336,505 B2
(45) **Date of Patent: *Jul. 2, 2019**

(54) PACKAGE WITH A MULTI-PIECE HANDLE

(71) Applicant: GPCP IP Holdings LLC, Atlanta, GA (US)

(72) Inventor: Gregory D. Moore, Madison, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/814,458

(22) Filed: Nov. 16, 2017

(65) Prior Publication Data

US 2018/0072464 A1 Mar. 15, 2018

Related U.S. Application Data

(63) Continuation of application No. 14/741,572, filed on Jun. 17, 2015, now Pat. No. 9,850,035.
(Continued)

(51) Int. Cl.
*B65D 5/465* (2006.01)
*B65D 33/10* (2006.01)
(Continued)

(52) U.S. Cl.
CPC ..... *B65D 33/10* (2013.01); *B65D 5/46016* (2013.01); *B65D 25/2873* (2013.01);
(Continued)

(58) Field of Classification Search
CPC ..... B65D 5/04; B65D 5/46008–46016; B65D 5/46024; B65D 33/10; B65D 25/2873;
(Continued)

(56) References Cited

U.S. PATENT DOCUMENTS 561,708 A 6/1896 Hensel
820,301 A 5/1906 Hale
(Continued)

FOREIGN PATENT DOCUMENTS

EP 0 150 136 A2 7/1985
EP 2 653 391 A1 10/2013
(Continued)

OTHER PUBLICATIONS

Notification of and International Search Report and Written Opinion dated Sep. 16, 2015, in corresponding International Patent Application No. PCT/US2015/036333.
(Continued)

*Primary Examiner* — Corey N Skurdal
(74) *Attorney, Agent, or Firm* — Laura L. Bozek

(57) ABSTRACT

A package for a product has a rigid package body and a handle for carrying the package. The rigid package body has at least six faces and a reclosable opening on a face of the rigid package body. The handle is positioned over the reclosable opening and has a first strap, a second strap, and a connection portion. The first strap includes a first end and a second end. The first end of the first strap is attached to one face of the package body. The second strap includes a first end and a second end. The first end of the second strap is attached to another face of the package body that is opposite to the face that is attached to the first strap. The connection portion is located on the second end of the second strap and is detachably engaged to the second end of the first strap.

38 Claims, 16 Drawing Sheets

Related U.S. Application Data

(60) Provisional application No. 62/013,627, filed on Jun. 18, 2014.

(51) Int. Cl.
*B65D 25/28* (2006.01)
*B65D 75/56* (2006.01)
*B65D 75/58* (2006.01)
*B65D 5/46* (2006.01)

(52) U.S. Cl.
CPC ..... *B65D 75/56* (2013.01); *B65D 75/58* (2013.01); *B65D 2575/586* (2013.01)

(58) Field of Classification Search
CPC ... B65D 75/56; B65D 75/58; B65D 2575/586
USPC ..... 229/117.09, 117.19, 117.26; 220/757, 220/760; 16/405; 294/148, 162, 167
See application file for complete search history.

(56) References Cited

U.S. PATENT DOCUMENTS

| | | | |
|---|---|---|---|
| 1,722,052 | A | 7/1929 | Lackey |
| 2,001,761 | A | 5/1935 | Bear |
| 2,856,069 | A | 10/1958 | Felber |
| 2,895,598 | A | 7/1959 | Whelan |
| 2,898,029 | A | 8/1959 | Sherman |
| 2,967,656 | A | 1/1961 | Vergobbi |
| 3,026,017 | A | 3/1962 | Hopkins |
| 3,031,359 | A | 4/1962 | Blank et al. |
| 3,081,674 | A | 3/1963 | Steen |
| 3,125,281 | A | 3/1964 | Woolen |
| 3,141,600 | A | 7/1964 | Rosenthal |
| 3,143,748 | A | 8/1964 | Manning |
| 3,240,420 | A | 3/1966 | Membrino |
| 3,346,883 | A | 10/1967 | Ersek |
| 3,452,922 | A | 7/1969 | Hart |
| 3,589,764 | A | 6/1971 | Cunningham et al. |
| 3,677,459 | A | 7/1972 | Susuki et al. |
| 4,140,164 | A | 2/1979 | Staup |
| 4,207,997 | A | 6/1980 | Croyle |
| 4,478,348 | A | 10/1984 | Cook |
| 4,509,645 | A | 4/1985 | Hotta |
| 4,691,368 | A | 9/1987 | Roessiger |
| 4,713,839 | A | 12/1987 | Peppiatt |
| D294,195 | S | 2/1988 | Starks |
| 4,738,546 | A | 4/1988 | Sengewald |
| 4,811,768 | A | 3/1989 | Williams |
| 4,854,733 | A | 8/1989 | Schwinn |
| 4,867,575 | A | 9/1989 | Wood |
| 4,874,255 | A | 10/1989 | Ball et al. |
| 4,877,335 | A | 10/1989 | Barnard |
| 4,934,535 | A | 6/1990 | Muckenfuhs et al. |
| 4,966,286 | A | 10/1990 | Muckenfuhs |
| 4,995,436 | A | 2/1991 | Cantor |
| 5,036,978 | A | 8/1991 | Frank et al. |
| 5,048,687 | A | 9/1991 | Suzuki et al. |
| 5,054,619 | A | 10/1991 | Muckenfuhs |
| 5,059,034 | A | 10/1991 | Schulz et al. |
| 5,080,281 | A | 1/1992 | Seabold |
| 5,112,138 | A | 5/1992 | Peppiatt |
| 5,121,995 | A | 6/1992 | Newman et al. |
| 5,186,542 | A | 2/1993 | Seabold |
| 5,282,687 | A | 2/1994 | Yee |
| 5,361,905 | A | 11/1994 | McQueeny et al. |
| 5,408,220 | A | 4/1995 | Brown et al. |
| 5,413,199 | A | 5/1995 | Clement |
| 5,427,245 | A | 6/1995 | Roussel |
| 5,464,285 | A | 11/1995 | Anderson |
| 5,570,833 | A | 11/1996 | Dusek |
| 6,012,842 | A | 1/2000 | Openiano |
| 6,095,686 | A | 8/2000 | Mohrmann |
| 6,279,747 | B1 | 8/2001 | Zegarra |
| 6,338,180 | B1 | 1/2002 | Massard |
| 6,478,463 | B2 | 11/2002 | Snider |
| 7,100,211 | B2 | 9/2006 | Bruffett |
| 7,160,028 | B1 | 1/2007 | Linday |
| 7,178,568 | B2 | 2/2007 | Wynona |
| 7,621,397 | B2 | 11/2009 | Boudrie et al. |
| 7,721,887 | B2 | 5/2010 | Hancock-Cooke et al. |
| 7,866,473 | B2 | 1/2011 | Clark, Jr. et al. |
| 8,032,986 | B2 | 10/2011 | Lawrence |
| 8,157,095 | B2 | 4/2012 | Motsch |
| 8,230,998 | B2 | 7/2012 | Boldra et al. |
| 8,490,793 | B2 | 7/2013 | Evenson et al. |
| 8,746,495 | B2 | 6/2014 | Turvey et al. |
| D722,233 | S | 2/2015 | Inskeep |
| 8,961,012 | B2 | 2/2015 | Martin et al. |
| 9,095,201 | B2 | 8/2015 | Simonsen |
| 9,708,085 | B2 | 7/2017 | Moore et al. |
| 2003/0131447 | A1 | 7/2003 | Mikus |
| 2006/0177160 | A1 | 8/2006 | Wagner |
| 2007/0261213 | A1 | 11/2007 | Nolan et al. |
| 2009/0223987 | A1 | 9/2009 | Wang |
| 2011/0048994 | A1 | 3/2011 | Eilert et al. |
| 2011/0308044 | A1 | 12/2011 | Lawrence |
| 2012/0145733 | A1 | 6/2012 | Heilman et al. |
| 2013/0008135 | A1 | 1/2013 | Moore et al. |
| 2014/0112599 | A1 | 4/2014 | Martin et al. |

FOREIGN PATENT DOCUMENTS

| | | | |
|---|---|---|---|
| FR | 766 709 | | 7/1934 |
| GB | 2 078 500 | A | 1/1982 |
| WO | 85/03274 | A1 | 8/1985 |
| WO | 89/12008 | A1 | 12/1989 |
| WO | 2014/029491 | A1 | 2/2014 |
| WO | 2015/178813 | A1 | 11/2015 |

OTHER PUBLICATIONS

Notification of and International Preliminary Report on Patentability dated Dec. 29, 2016, in corresponding International Patent Application No. PCT/US2015/036333.

Scotch® Easy Open Carry Handle 8643 Clear, 24 mm×1000 m, 8 rolls per case Bulk, accessed May 1, 2013, two pages.

Scotch® Easy Open Carry Handle 8643 Clear, 36 mm×1000 m, 4 rolls per case Bulk, accessed May 1, 2013, two pages.

3M, Carry Handles, accessed May 1, 2013, three pages.

3M™ ScotchPad™ Carry Handle 8328 White, 1-3/8 in×23 in×6 in, 25 handles per pad, 80 pads per case Bulk, accessed May 1, 2013, two pages.

3M™ ScotchPad™ Carry Handle 8326 White, 1-3/8 in×23 in×6 in, 25 handles per pad, 80 pads per case Bulk, accessed May 1, 2013, two pages.

3M™ ScotchPad™ Carry Handle 8326 White, 1-3/8 in×23 in×6 in, 25 handles per pad, 80 pads per case Boxed, accessed May 1, 2013, two pages.

Scotch® Carry Handle Tape 8347 Clear, 1 in×5470 yd Boxed, accessed May 1, 2013, two pages.

3M, Carry Handles, Technical Data, Dec. 2013, three pages.

3M, Carry Handle Tape 8346HP, Technical Data, Jan. 2014, three pages.

Chemsultants® International, Markets—Labels, Tapes & Converting, accessed Jun. 4, 2013, one page.

3M, ScotchPad™ Custom Carry Handle White Carry Handle 8325 • 8326, Technical Data, May, 2009, three pages.

Scotch®, Automatic Carry Handle Selection Guide, Technical Information, 2000, one page.

3M, ScotchPad™ Custom Carry Handle (8327HD) White Carry Handle (8328HD) 8327 • 8328, Technical Data, Jan. 2004, four pages.

Scotch®, Carry Handle Tape 8347, Technical Data, Jan. 2004, three pages.

PACKAGE WITH A MULTI-PIECE HANDLE

CROSS REFERENCE TO RELATED APPLICATION

This application is a continuation application of U.S. patent application Ser. No. 14/741,572, filed Jun. 17, 2015, now U.S. Pat. No. 9,850,035, issued Dec. 26, 2017, which claims priority to U.S. Provisional Patent Application No. 62/013,627, filed Jun. 18, 2014, each of which is incorporated herein in its entirety.

FIELD OF THE INVENTION

My invention relates to a package such as a package for consumer products. In particular, my invention relates to a package having a multi-piece handle positioned over a reclosable opening of the package.

BACKGROUND OF THE INVENTION

Consumer products are sold in packaging of various shapes, sizes, and materials of construction. Some of these products do not fit in conventional shopping bags when purchased at a store. By way of example, these products may be too large for a bag, too heavy, or a combination of both. For example, a stand mixer is a heavy product (weighing approximately twenty-five pounds) that is typically sold in a cardboard box approximately sixteen inches by twenty inches by twelve inches. Bulky packages are particularly the norm at so-called warehouse or club stores such as Costco Wholesale, BJ's Wholesale Club, or Sam's Club. In these stores, products are typically sold in bulk, which results in large packages for many types of products. For example, paper towels or tissue products may come in packages containing eight rolls or more. An eight count package of paper towels is approximately twenty-two inches by twelve inches by twelve inches. Consumers desire a convenient way to carry and to move these products, for example, from the store to home.

One way to facilitate the movement of these products is to integrate handles into the packaging. For example, a cardboard box may have perforations in the side of the box that allow a section to be punched out and used as a hand hold.

Another way to facilitate movement is to attach handles to the package, with a pressure sensitive adhesive. One such handle is described in U.S. Patent Appln. Pub. No. 2012/0145733. This handle has a dog-bone or an hour-glass shape that is narrower at a grip portion and wider at an attachment portion. Another such handle is described in U.S. Pat. No. 8,032,986. This handle is built from three main layers. In its initial condition, a flexible handle is folded between a top layer and a bottom layer. The top layer has a hole through which the flexible handle may be unfolded and used to carry a package. The hole is covered with a protective plastic covering while the flexible handle is in the folded state. Each of the layers is connected to the other layers with a pressure sensitive adhesive, and the bottom layer is attached to a package through a pressure sensitive adhesive. Still another handle is described in U.S. Pat. No. 7,621,397. This patent describes a band that completely or partially encircles a package. The band itself may serve as a handle, or a strap may be attached to the bands to serve as the handle. Yet another handle is a carry handle available from 3M Company of St. Paul, Minn. This handle is a single strap of plastic with a paper backing. Each end of the strap can then be attached to a package using a pressure sensitive adhesive.

While packages incorporating the handles described above are useful for moving the packages, they have disadvantages for subsequent storage of the products. With products purchased in bulk at a club store, for example, consumers often desire to store the products in the original packaging and take out a single product as needed. The original packaging can provide a convenient way to keep the products together and to protect the products from dirt or damage. The handles described above, however, get in the way of removing the product from the package, and consumers are required to remove the handles. Frequently, removing the handles tears a hole in the side of the package and the package thus no longer protects the products contained inside. There is, therefore, a need for an improved package with a handle that allows a consumer to access products within the package.

SUMMARY OF THE INVENTION

In one aspect, my invention relates to a package having, in general, a rigid package body and a handle for carrying the package. The rigid package body has at least six faces and a reclosable opening on a face of the rigid package body. The handle is positioned over the reclosable opening and has a first strap, a second strap, and a connection portion. The first strap includes a first end and a second end. The first end of the first strap is attached to one face of the package body. The second strap includes a first end and a second end. The first end of the second strap is attached to another face of the package body that is opposite to the face that is attached to the first strap. The connection portion is located on the second end of the second strap and is detachably engaged to the second end of the first strap.

In another aspect, my invention relates to a package having, in general, a rigid package body and a handle for carrying the package. The rigid package body has at least six faces and a reclosable opening on a face of the rigid package body. The handle is positioned over the reclosable opening and has a first strap, a second strap, and a connecting strap. The first strap includes a first end and a second end. The first end of the first strap is attached to one face of the package body. The second strap includes a first end and a second end. The first end of the second strap is attached to another face of the package body that is opposite to the face that is attached to the first strap. The connecting strap is (i) detachably engaged to the second end of the first strap and (ii) detachably engaged to the second end of the second strap.

These and other aspects of my invention will become apparent from the following disclosure.

DETAILED DESCRIPTION OF THE PREFERRED EMBODIMENTS

I will now describe my invention with reference to the attached figures depicting several exemplary preferred embodiments of my invention.

To aid in understanding my invention, the description uses the terms top, bottom, end, and side, for example, to describe various faces of a package body. Those skilled in the art will recognize that these terms can be used interchangeably. For example, a top can also be a side or an end, and vice versa.

First Embodiment

Figure 1:
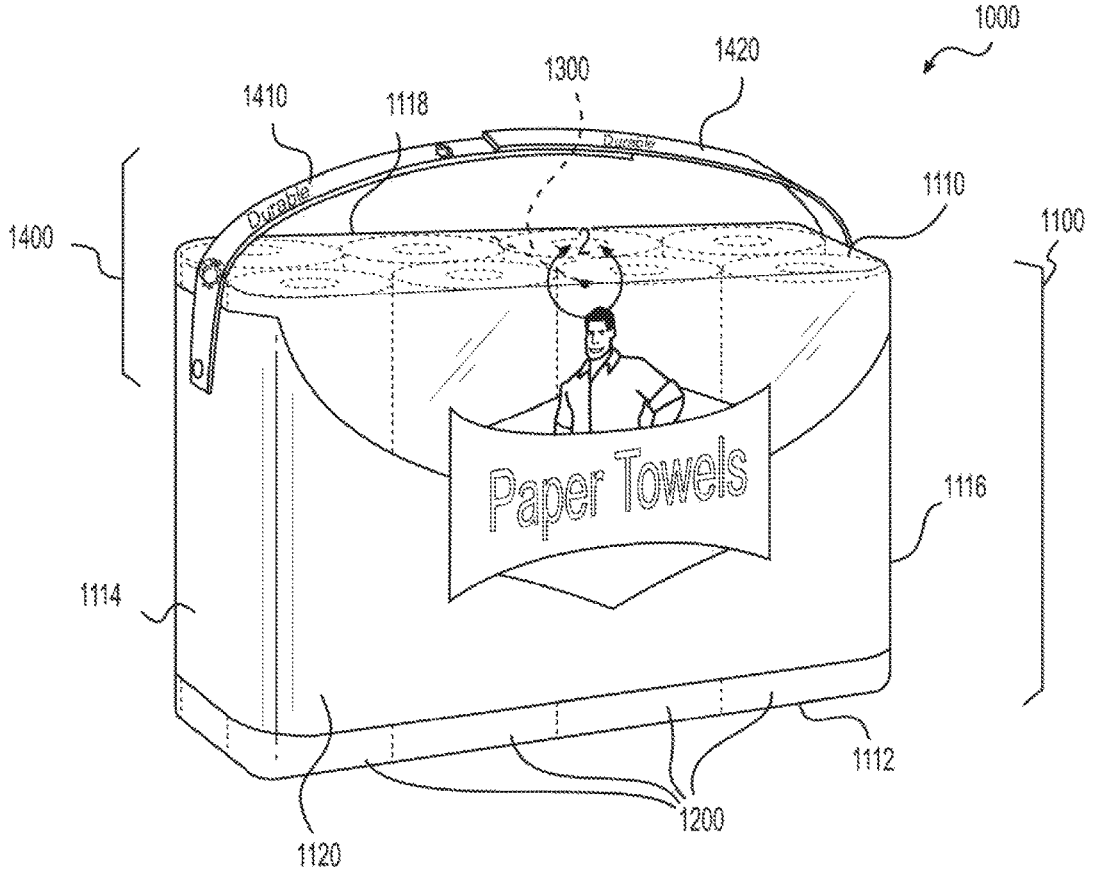
FIG. 1 shows an exemplary preferred embodiment of a package according to my invention.

FIG. 1 shows a package 1000 in accordance with an exemplary preferred embodiment of my invention. This package 1000 includes a flexible package body 1100 having six faces, a top face 1110; a bottom face 1112; two end faces 1114, 1116; and two side faces 1118, 1120. The top face 1110 and bottom face 1112 are opposite to one another. Similarly, the two end faces 1114, 1116 are opposite to one another, and the two side faces 1118, 1120 are opposite to one another. The flexible package body 1100 is made from a flexible material such as plastic or paper. When the flexible package body 1100 is made of plastic, the plastic may be a polyolefin such as polyethylene or polypropylene, a polyester such as polyethylene terephthalate (PET), or a polyamide such as nylon. The plastic may also be made from a plasticized polyvinyl chloride or polyvinylidene chloride. Those skilled in the art will recognize that other suitable materials may be used as the flexible packaging. The flexible packaging may be transparent, translucent, or opaque, and may include graphics or text printed on the flexible packaging.

In this embodiment, the package 1000 contains a rolled paper product 1200 such as paper towels or bathroom tissue. Those skilled in the art will recognize, however, that my invention may be adapted to contain any suitable product. The rolled paper product 1200 is typically aligned into two or more rows and then wrapped in the plastic. The top face 1110 and bottom face 1112 of the plastic are then folded and glued. The paper may be packaged using any suitable method known to those skilled in the art such including the method described in U.S. Patent Appln. Pub. No. 2013/0008135 (the disclosure of which is incorporated by reference in its entirety). Further, any suitable automated bagger, bundler, or overwrapper known in the art such as an Ultraflow wrapper manufactured by Paper Converting Machine Company of Green Bay, Wis. or a Casmatic wrapper manufactured by Fabi Perini of Lucca, Italy may be used for my invention.

Figure 3:
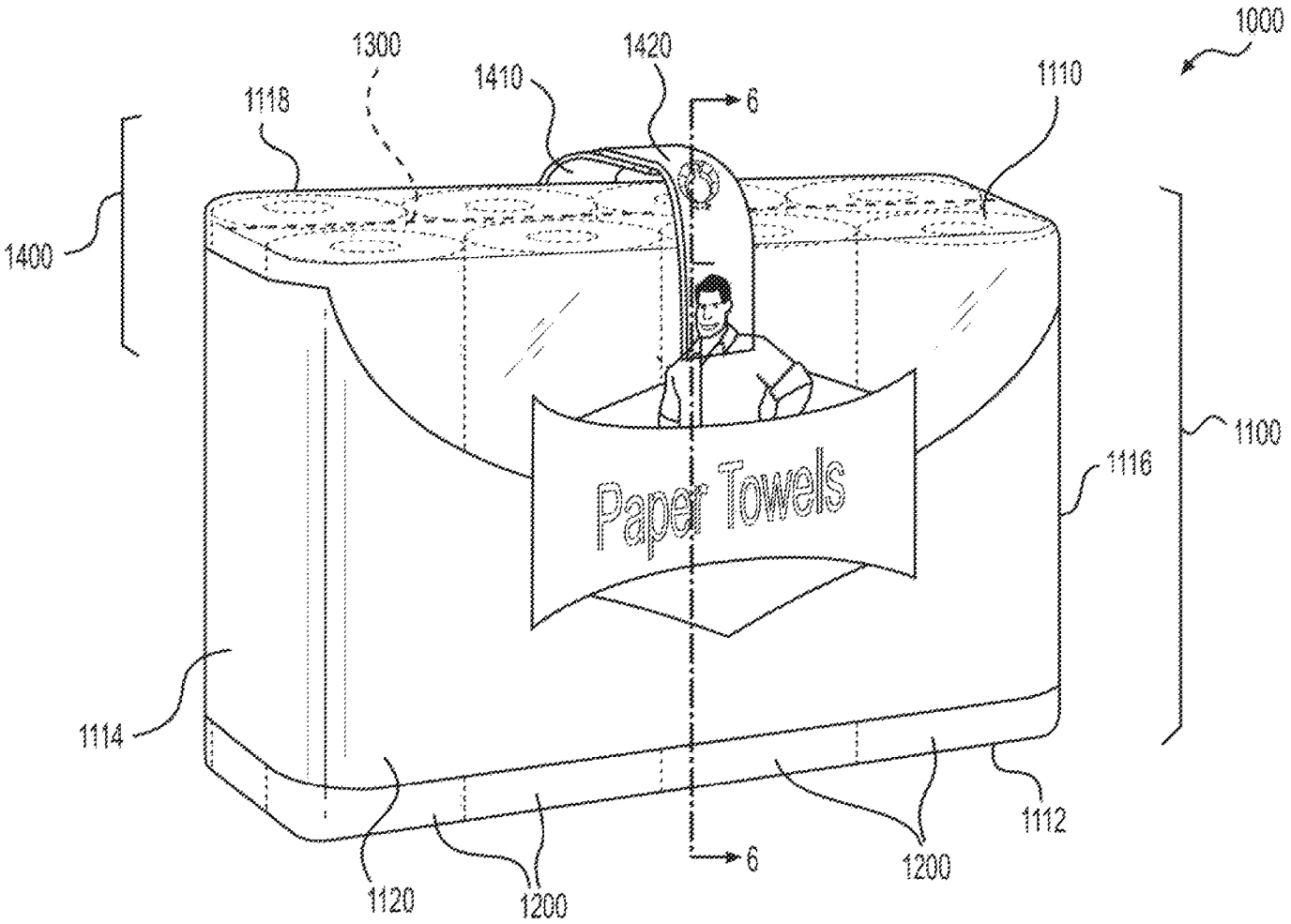
FIG. 3 shows an alternate handle location for the package shown in FIG. 1.
Figure 4:
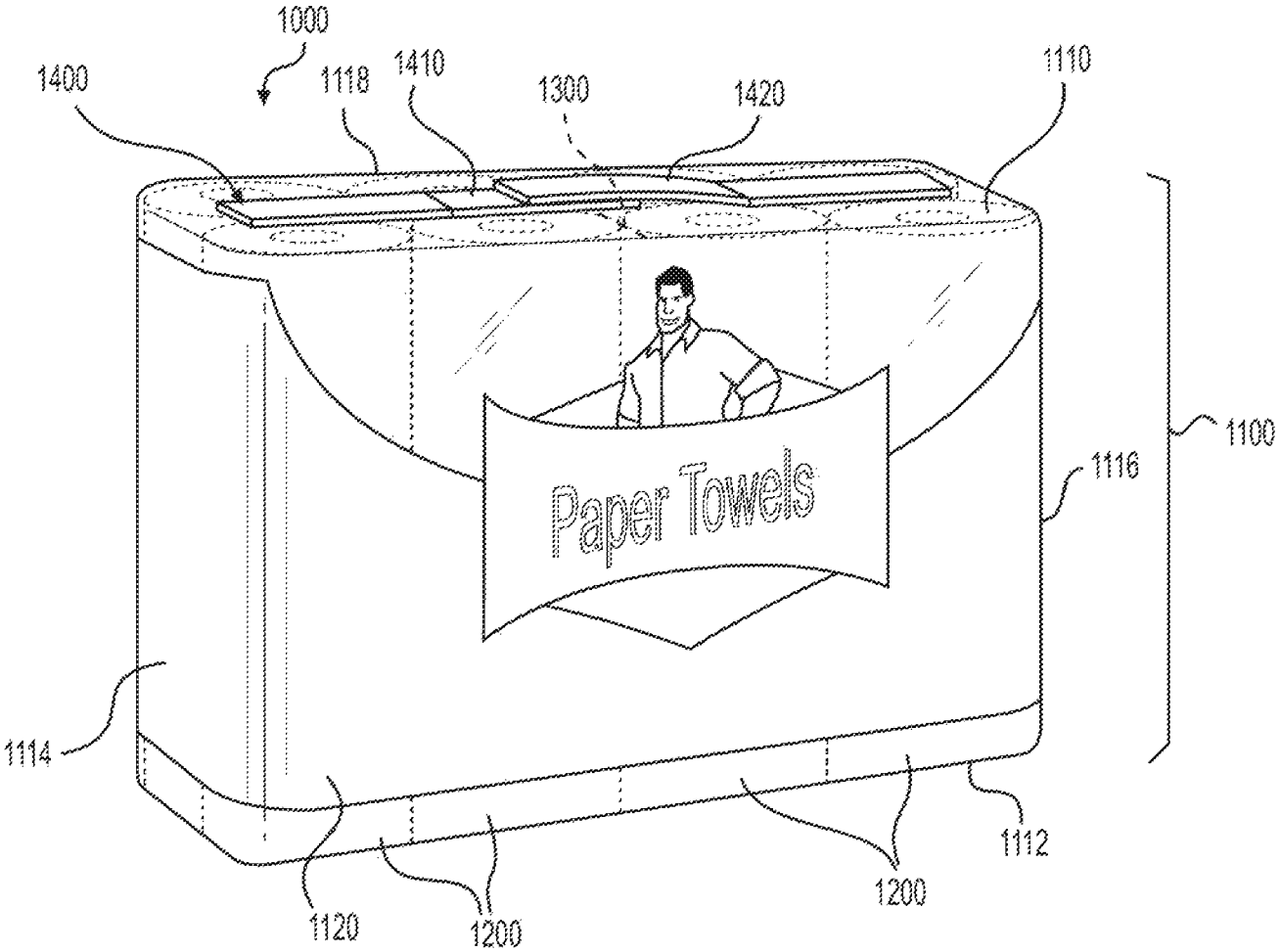
FIG. 4 shows another alternate handle location for the package shown in FIG. 1.
Figure 5:
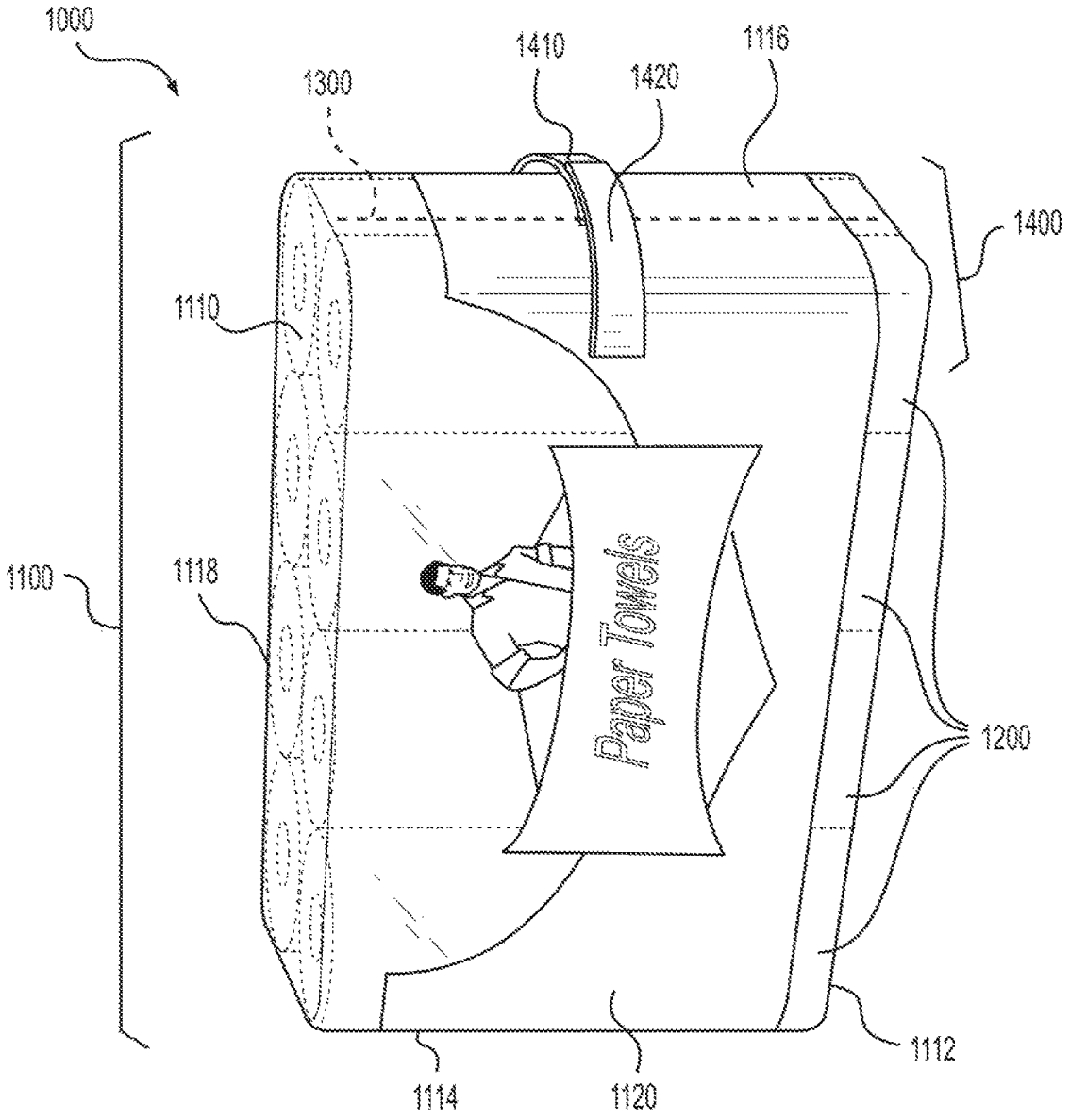
FIG. 5 shows yet another alternate handle location for the package shown in FIG. 1.

The flexible package body 1100 shown in FIGS. 1, 3, and 4 has a reclosable opening 1300 on the top face 1110. This reclosable opening 1300 is sized to allow a consumer to remove one of the rolled paper products 1200 from the package 1000. The reclosable opening 1300 may also be suitably located on other faces of the flexible package body 1100. In FIG. 5, for example, the reclosable opening 1300 is located on end face 1116 of the package 1000.

Figure 2A:
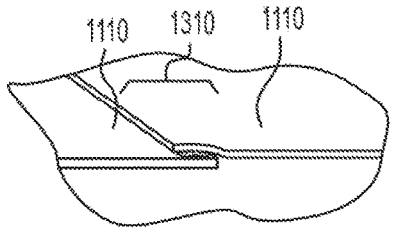
FIGS. 2A, 2B, and 2C are examples of Detail 2 from FIG. 1 showing alternate reclosable openings.
Figure 2B:
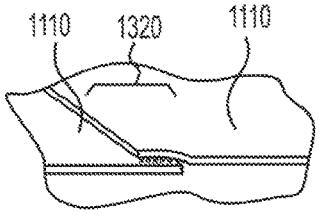
Figure 2C:
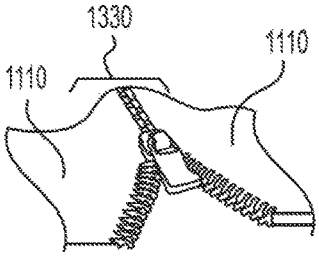

A reclosable opening 1300 is any suitable opening in the package body 1100 that may be opened and then closed. This definition not only includes resealable openings (as discussed below), it also includes openings known in the art that are re-closed using an external clasp or tape. In the embodiment shown in FIG. 1, the reclosable opening 1300 is formed by making a series of linear perforations on the top face 1110 of the package body 1100. A user opens the reclosable opening 1300 by tearing along the series of perforations. The tearing action creates two adjacent edges of the package body 1100. The reclosable opening 1300 may be re-closed by overlapping the two adjacent edges and sealing with tape, a clasp, or the like. Other reclosable openings that are contemplated within the definition above include printed directions on the package 1000. The printed directions may include, for example, "open here," "tear here," or "cut here," and these instructions may be accompanied by printed markings along the top face 1110 of the package body 1100, indicating where to open, to tear, or to cut. The instructions may also accompany notches in the flexible packaging that are used to facilitate opening. Another suitable reclosable opening may include, for example, the use of a tear tape embedded in the top face 1110 of the package body 1100. Alternatively, the reclosable opening 1300 may be a resealable opening 1310, 1320, 1330. As shown in FIGS. 2A, 2B, and 2C, any suitable resealable closure may be used, including a pressure sensitive adhesive 1310, a hook and loop fastener 1320, or a zipper 1330.

The package 1000 shown in FIGS. 1, 3-6, and 9-10 also includes a handle 1400 positioned over the reclosable opening 1300. The handle 1400 is used to carry the package 1000. To carry the package 1000, a user would typically place his or her hand in the space between the face of the package body 1100 having the reclosable opening 1300, and then grab the handle. The user would then lift the package 1000 using his or her hand and arm to carry the package 1000.

The handle 1400 may be made from any suitable material known to those skilled in the art. As may be seen in FIG. 6, the handle 1400 of this embodiment has a plastic layer 1402 with a paper backing 1404. Any suitable plastic may be used for the plastic layer 1402 of the handle 1400 including, for example, a polyolefin such as polyethylene or polypropylene, a polyester such as polyethylene terephthalate (PET), or polyamide such as nylon. The plastic layer 1402 of the handle 1400 may also be made from a plasticized polyvinyl chloride or polyvinylidene chloride. In addition, the plastic layer 1402 of the handle 1400 may be fiber reinforced to provide extra strength to the handle 1400. Such reinforcing fibers can include cellulosic fibers or glass fibers. The handle 1400 may be may be transparent, translucent, or opaque and may include graphics or text printed on the handle 1400 (see FIGS. 1, 3, and 9). Although the graphics or text may be included on the plastic layer 1402, for ease of construction, the graphics and text may be printed on the paper backing 1404.

Figure 6:
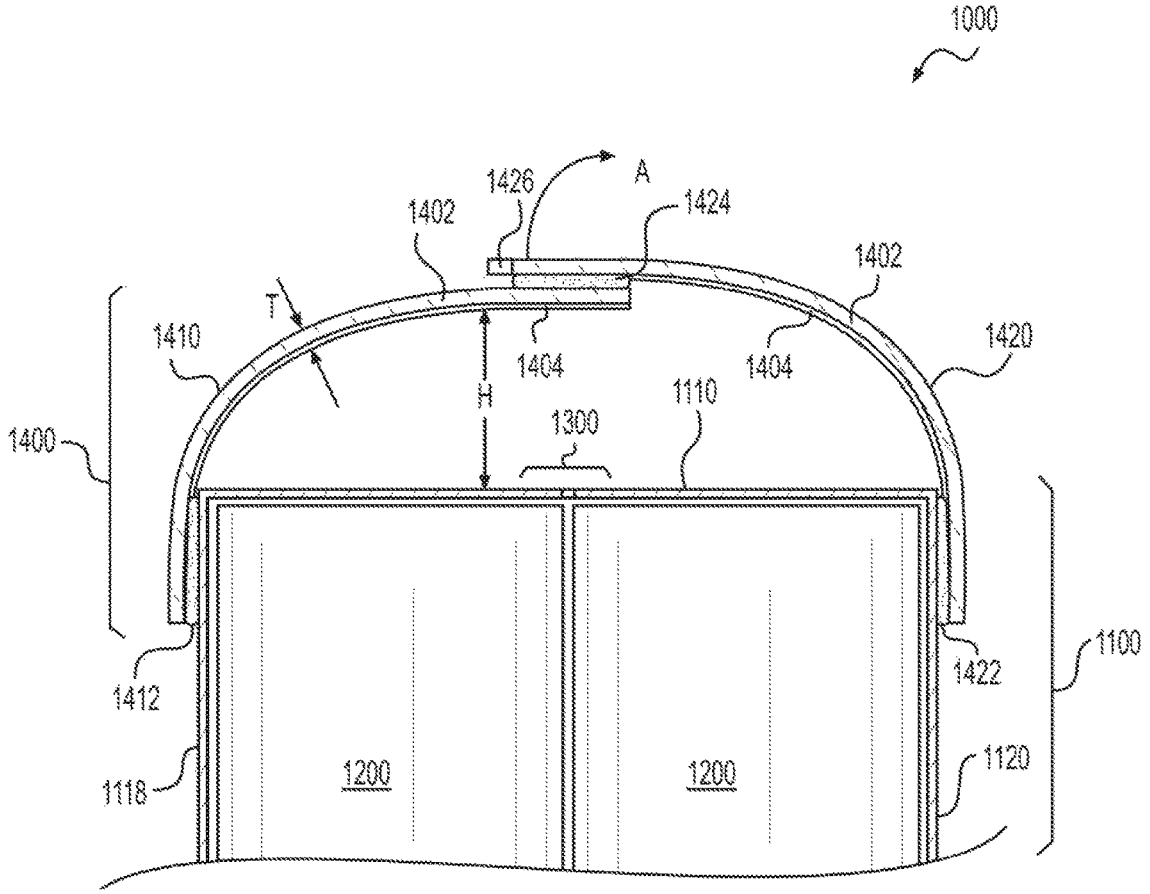
FIG. 6 is a cross-sectional view of a portion of the package shown in FIG. 3, taken along line 6-6.
Figure 7A:
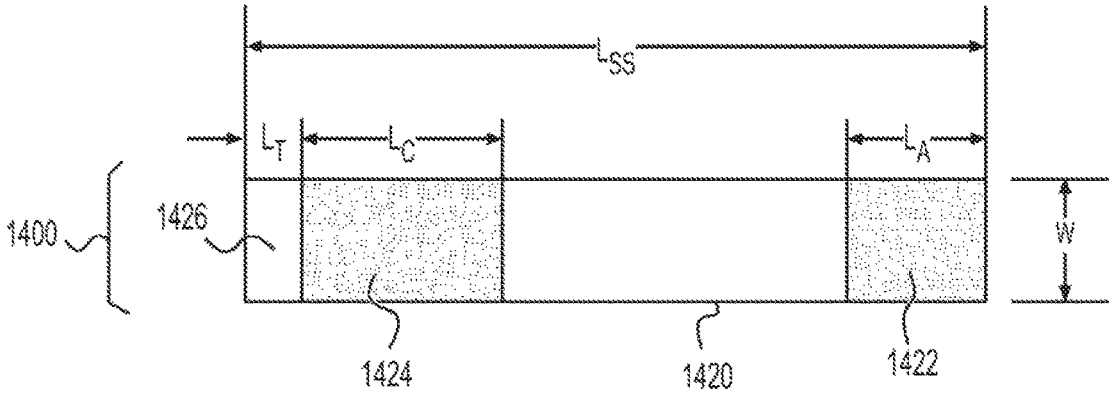
FIGS. 7A and 7B show undersides of each strap of the handle used in the packages shown in FIGS. 1 and 3-6.
Figure 7B:
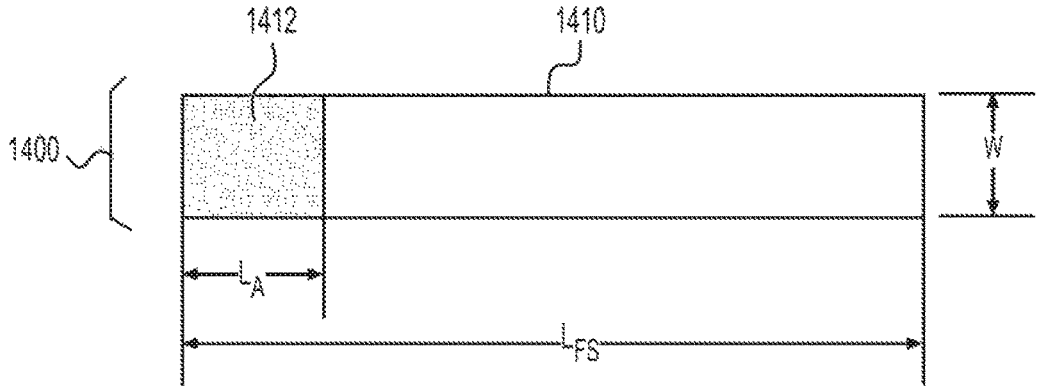

As shown in FIGS. 6, 7A, and 7B, the handle 1400 of this embodiment has two straps, a first strap 1410 and a second strap 1420. When the reclosable opening 1300 is positioned on the top face 1110 of the package 1000 as shown in FIG. 1, the first strap 1410 is attached to one end face 1114 of the package body 1100 and the second strap 1420 is attached to the other end face 1116 of the package body 1100. Alternatively, the first strap 1410 may be attached to one side face 1118 of the package body 1100 and the second strap 1420 may be attached to the other side face 1120 of the package body 1100, as shown in FIG. 3.

FIG. 4 shows another alternative. Here, both the first and second straps 1410, 1420 are attached to the same face (top face 1110) that includes the reclosable opening 1300. The first and second straps 1410, 1420 are attached opposite to each other and the handle 1400 spans over the reclosable opening 1300. When the reclosable opening 1300 is positioned on one of the end faces 1116, the first strap 1410 may be positioned on one side face 1118 of the package body 1100 and the second strap 1420 may be positioned on the other side face 1120 of the package body 1100, as shown in FIG. 5.

Figure 8A:
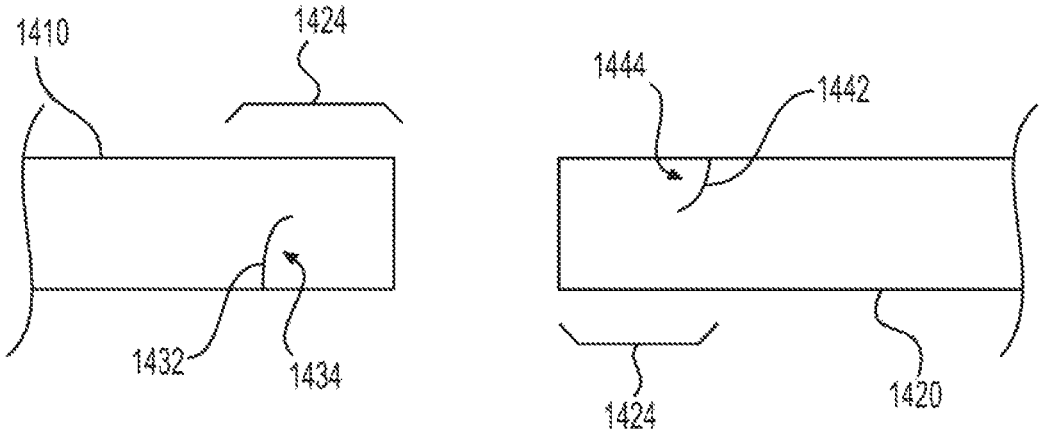
FIGS. 8A and 8B show undersides of each strap of the handle used in packages shown in FIGS. 1 and 3-6, having an alternate connection portion.
Figure 8B:
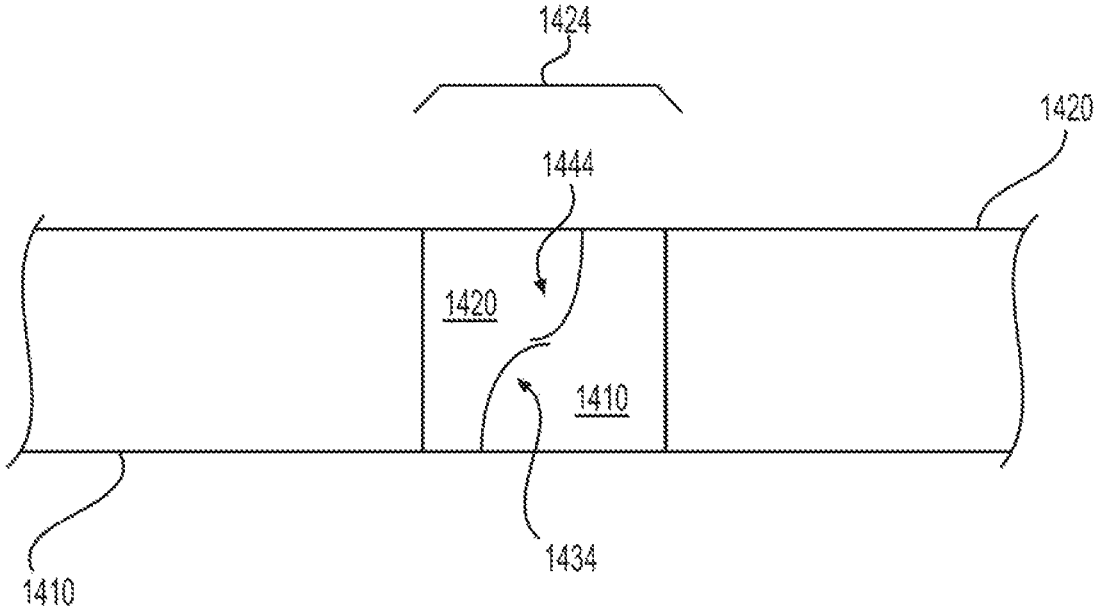

The second strap 1420 has a connection portion 1424 on one end of the strap. This connection portion 1424 is detachably engaged to one end of the first strap 1410. In the preferred embodiment, the connection portion 1424 has a pressure sensitive adhesive applied to the plastic layer 1402 of the second strap 1420. Those skilled in the art will recognize, however, that any suitable detachable connection may be used, including a hook and loop closure or mechanical clasps such as buttons or snaps. Another suitable detachable connection may include die cutting the ends of the first and second straps 1410, 1420 to have complementary shapes, allowing the ends of the first and second straps 1410, 1420 to engage with one another. As shown in FIG. 8A, for example, a first die cut 1432, forming a first rounded tab 1434, is made in the end of the first strap 1410, and a second die cut 1442, forming a second rounded tab 1444, is made in the end of the second strap 1420. The first and second rounded tabs 1434, 1444 are complementary, allowing the ends of the first and second straps 1410, 1420 to slide together and to engage with one another, as shown in FIG. 8B. In the embodiment shown in FIGS. 8A and 8B, there are two connection portions 1424, one on each end of the first and second straps 1410, 1420.

Figure 9:
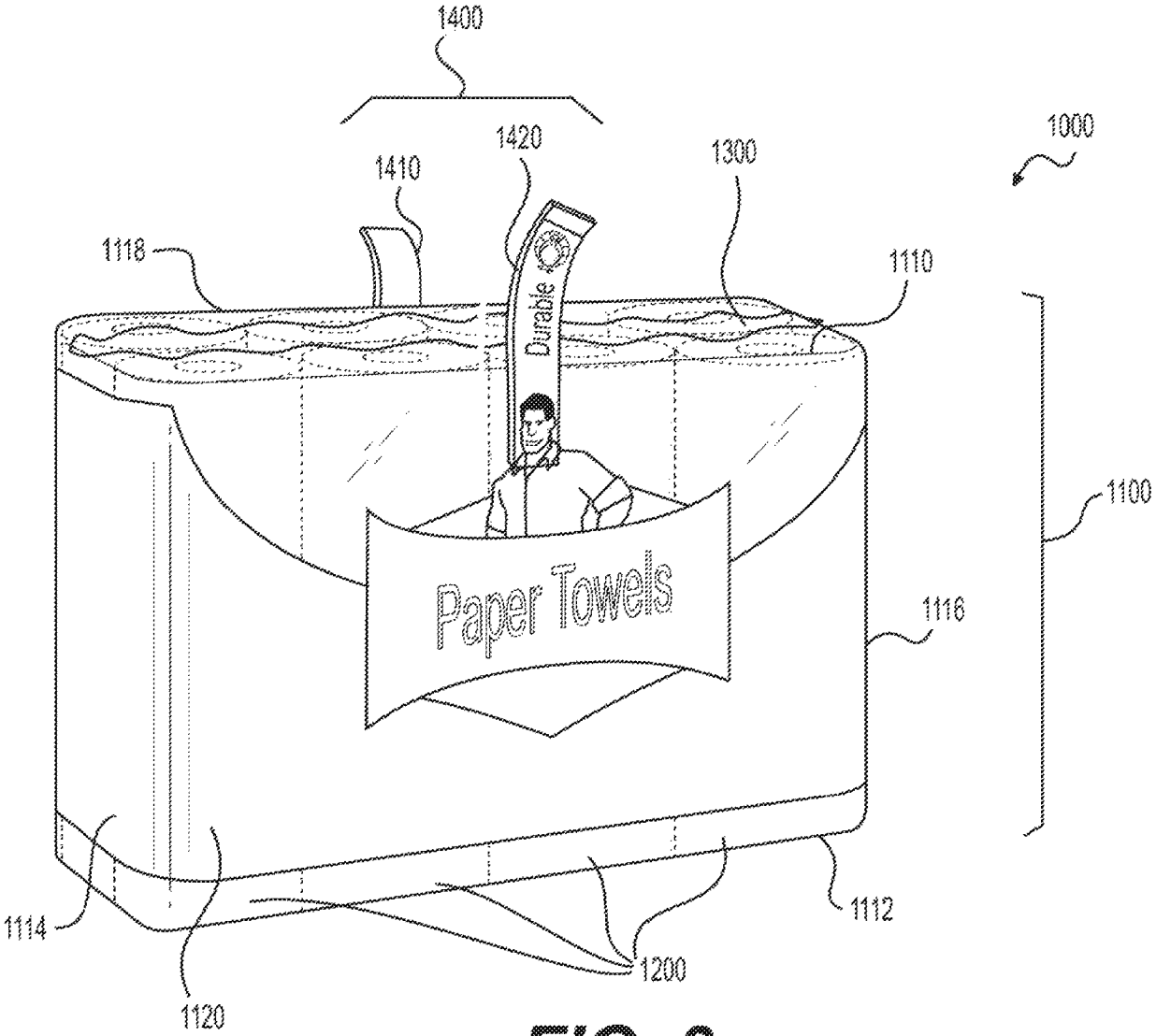
FIG. 9 shows the package of FIG. 3 in an open condition.

When pressure sensitive adhesive is used, the connection portion 1424 does not have paper backing and the pressure sensitive adhesive may be applied to the exposed plastic layer 1402 of the second strap 1420, as shown in FIGS. 6, 7A, and 7B. The pressure sensitive adhesive is then used to detachably engage the connection portion 1424 with the plastic layer 1402 of the first strap 1410. The handle 1400 may be opened by detaching the connection portion 1424 from the first strap 1410 by pulling the second strap 1420 in direction A. FIG. 9 shows the package 1000 of this embodiment in an open condition. After the handle 1400 has been opened, the reclosable opening 1300 may be opened to allow a user to remove a rolled paper product 1200 from the package 1000. The package 1000 may be closed by closing the reclosable opening 1300 and re-engaging the connection portion 1424 with the plastic of the first strap 1410 to return the handle 1400 to its original condition.

The second strap 1420 may also include a tab 1426, as shown in FIGS. 6 and 7A, to assist in detaching the connection portion 1424 from the first strap 1410. The tab 1426 may be positioned adjacent to the connection portion 1424 at one end of the second strap 1420. The tab 1426 may be a portion of the handle 1400 that does not include pressure sensitive adhesive. This tab 1426 is sized to allow a user to easily grasp the tab 1426 and the tab length $L_T$ is preferably from about one-quarter inch to about one inch long. Tabs larger than about one inch run the risk of snagging on an object, resulting in an inadvertent opening of the handle 1400.

Figure 10:
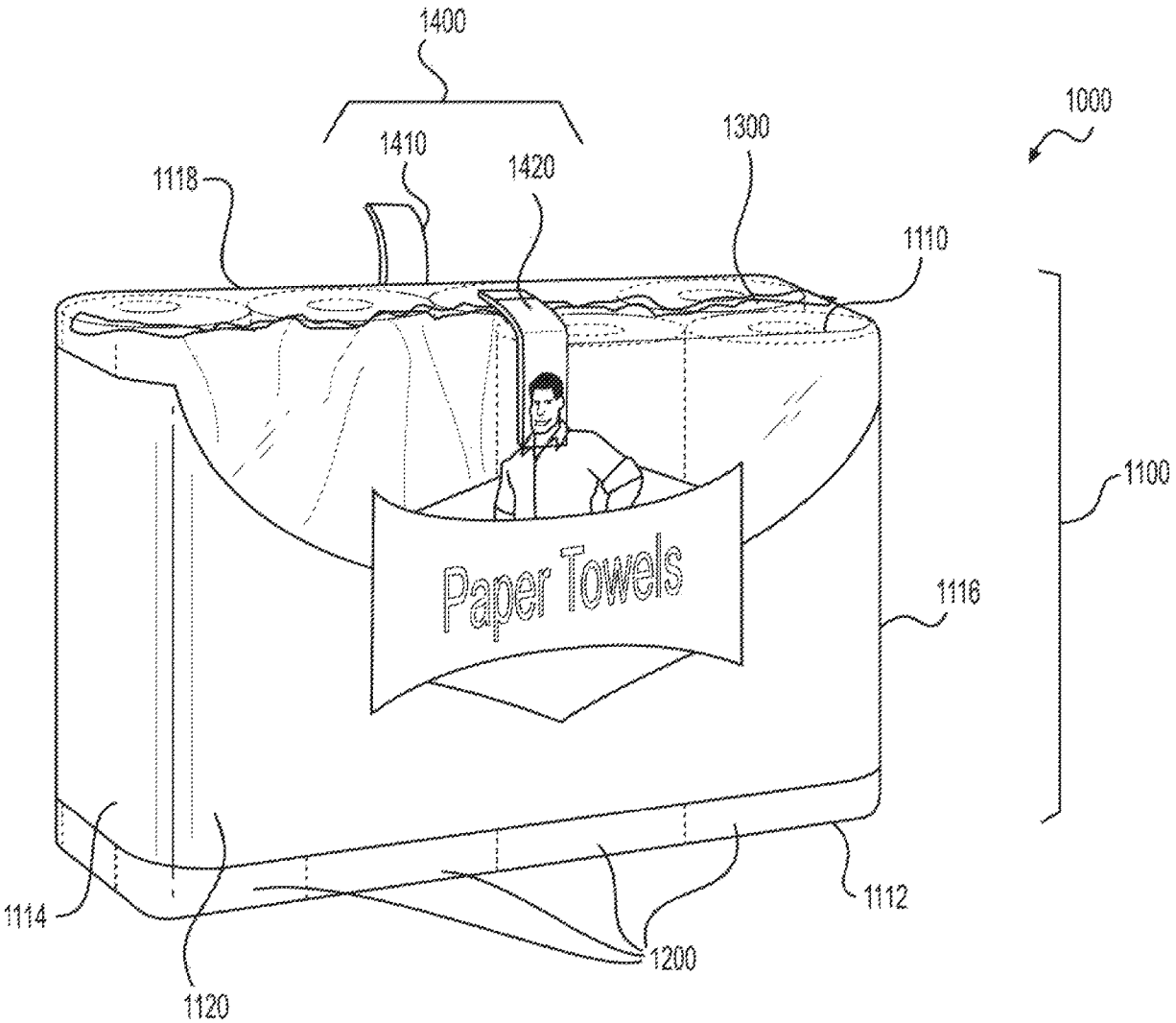
FIG. 10 shows the package of FIG. 9 in a closed condition after a product has been removed.
Figure 11:
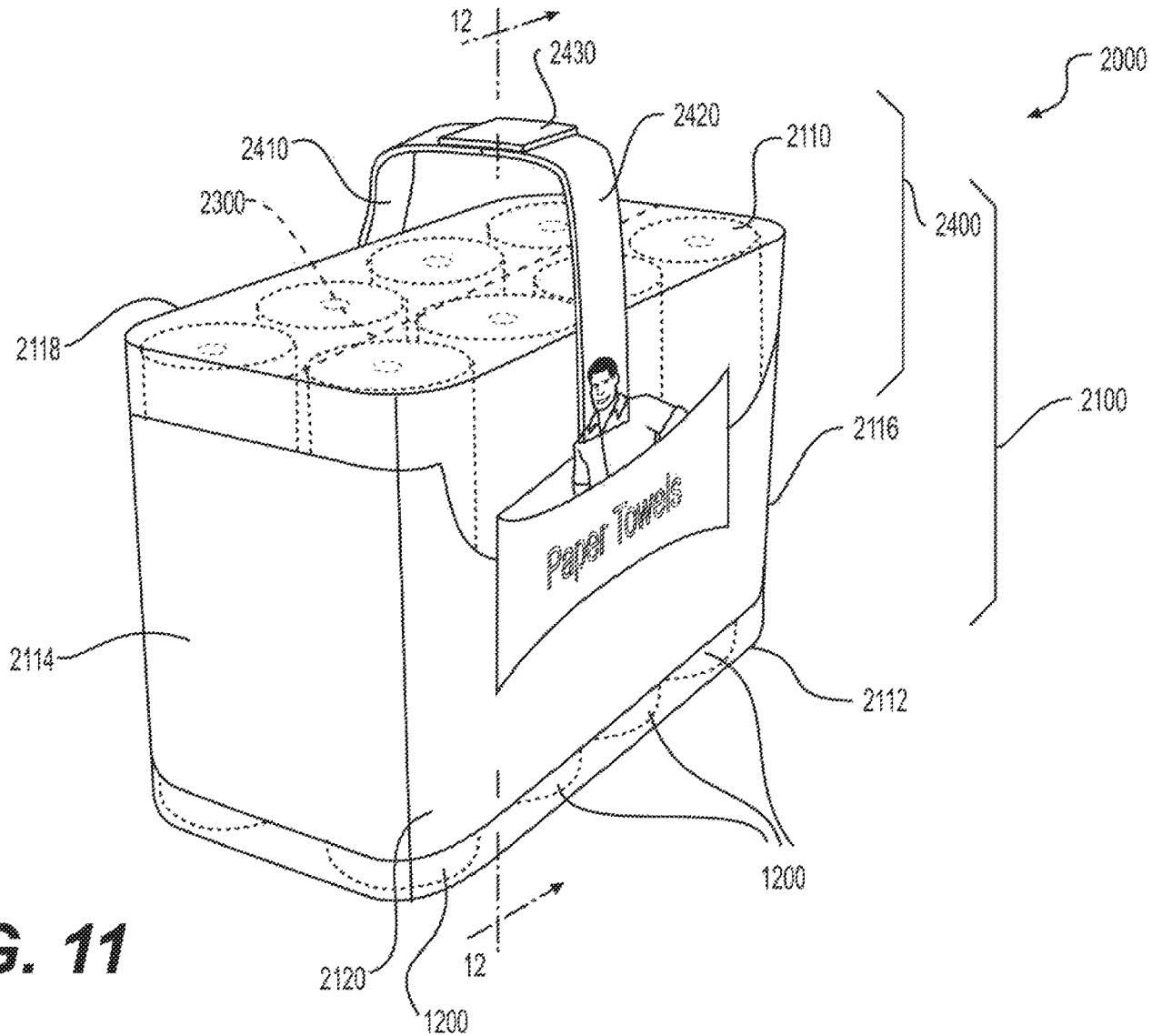
FIG. 11 is a second embodiment of the package of my invention.

The handle 1400 may also be used to close the reclosable opening as shown in FIG. 10. This use of the handle 1400 is particularly beneficial when the reclosable opening 1300 is not itself resealable. Such an example of a reclosable opening 1300 is when the reclosable opening 1300 is created by a line of perforations on the top face 1110. The reclosable opening 1300 is opened by tearing the top face 1110 along the perforations. To reseal this opening after a rolled paper product 1200 has been removed, the flexible packaging of top face 1110 may be bunched, gathered, or overlapped. Then, the second strap 1420 may be used to cinch the reclosable opening closed by detachably engaging the connection portion 1424 (FIGS. 6 and 7A) with the flexible package body 1100.

In the first embodiment as described in the foregoing paragraphs and illustrated in the figures described therein, each strap is generally a flat strip of material having a length, $L_{FS}$ (first strap length), $L_{SS}$ (second strap length), a width W, and a thickness T, as shown in FIGS. 6, 7A, and 7B. The width W of the handle 1400 is preferably sized to fit comfortably in a person's hand without being too large for the hand or too narrow as to cut into the hand for a heavy package 1000. Preferably, the width W of the handle 1400 is from about one-quarter inch to about three inches wide, more preferably, from about three-quarters inch to about one and a half inches wide. Those skilled in the art will recognize that the thickness T of the strap is determined based on the desired handle 1400 strength and rigidity. A common thickness for thin plastic films used in my invention may range from about two millionths of an inch to about ten millionths of an inch.

The connection portion 1424 is sized to prevent the two straps from becoming detached from the weight of the package 1000 when a user carries the package 1000 using the handle 1400. When a pressure sensitive adhesive is used, those skilled in the art will recognize that the strength of a connection between the first strap 1410 and second strap 1420 is a function of the surface area of the connection portion 1424 and the tack of the pressure sensitive adhesive for the material selected for the handle 1400. The connection portion 1424 length $L_C$ is preferably from about one inch to about twenty-four inches, more preferably, from about two inches to about ten inches, even more preferably, from about three inches to about six inches.

The first 1410 and second 1420 straps may be attached to the flexible package body 1100 by any suitable means known to those skilled in the art, including a pressure sensitive adhesive or mechanical clasps. In this embodiment, the portion of each strap that attaches to the flexible package body 1100, an attachment portion 1412, 1422, does not have paper backing. Instead, a pressure sensitive adhesive is applied directly to the plastic layer 1402 of each strap 1410, 1420 and the attachment portions 1412, 1422 are attached directly to the package body 1100. When pressure sensitive adhesive is used to attach each strap to the package body 1100, the surface area of the attachment portion 1412, 1422 shown in FIGS. 6A and 6B is generally determined by the weight of the package 1000 similarly to determining the size of the connection portion 1424. The attachment portion 1412 length $L_A$ is preferably from about three inches to about six inches.

Those skilled in the art will recognize that the total length of the handle 1400 and the corresponding first strap length $L_{FS}$ and second strap length $L_{SS}$ are determined based upon the size of the package body 1100. The total length of the handle 1400 should be long enough to span one face of the package body 1100 (e.g., top face 1110 shown in FIG. 6). The handle 1400 should also have additional length to space the handle a height H from the top face 1110 of the package body 1100. The height H should be set to allow a user to comfortably slide his or her hand between the top face 1110 and the handle 1400 when picking up the package 1000. When the first and second straps 1410, 1420 of the handle 1400 are attached to the same face (top face 1110) of the package body 1100, as shown in FIG. 4, the height H may be set by the total length of the handle and the distance between the attachment portions 1412, 1422. The handle 1400 may be tighter (e.g., have a smaller height H) when the package body 1100 has some space (looseness) around the rolled paper products 1200 because the looseness in the packaging will allow a user to slide his or her hand between the top face 1110 and the handle 1400.

Second Embodiment

The package 2000 of a second embodiment of my invention, as shown in FIGS. 11-14, incorporates many features of the first embodiment. As in the first embodiment, the package 2000 has a flexible package body 2100 having six faces, a top face 2110; a bottom face 2112; two end faces 2114, 2116; and two side faces 2118, 2120. The package 2000 of this embodiment has a reclosable opening 2300 on the top face 2110. The handle 2400 of this embodiment, however, comprises three straps instead of two. The first strap 2410 and the second strap 2420 each has an attachment portion 2412, 2422 to connect the strap to opposite faces of the package body 2100, similar to attachment portions 1412, 1422 (FIGS. 6, 7A, and 7B) described in connection with the first embodiment. Instead of the second strap 1420 overlapping the first strap 1410 and the straps being detachably engaged by the connection portion 1424 on the second strap 1420 (as in the first embodiment, see FIG. 6), a connecting strap 2430 is detachably engaged to ends of the first and second strap 2410, 2420. As with the connection portion 1424 (FIG. 6) of the first embodiment, those skilled in the art will recognize that the connecting strap 2430 may be detachably engaged to both the first 2410 and second 2420 straps using any suitable means, including a hook and loop closure and a pressure sensitive adhesive.

Figure 12:
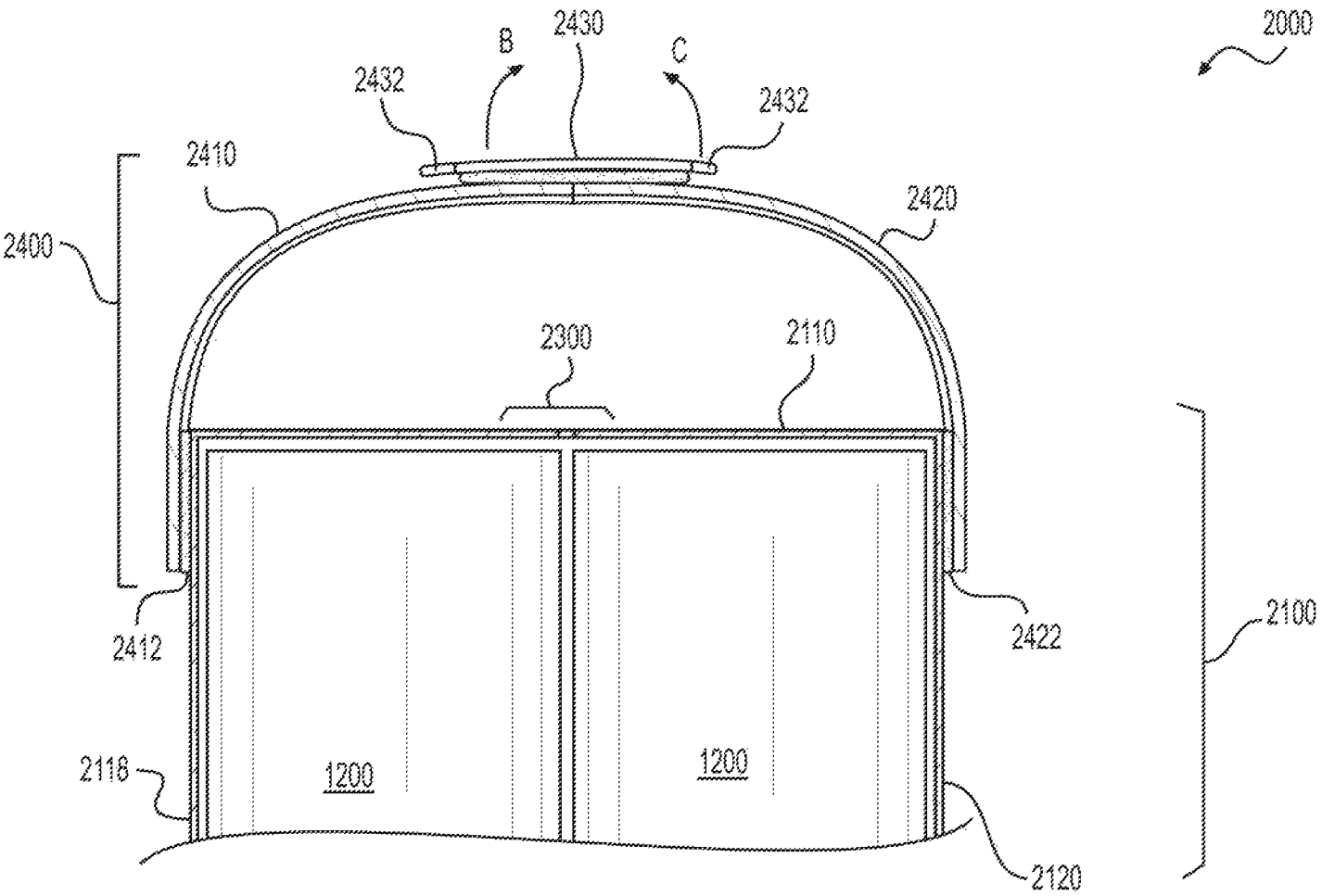
FIG. 12 is a cross-sectional view of a portion of the package shown in FIG. 11, taken along line 12-12.
Figure 13A:
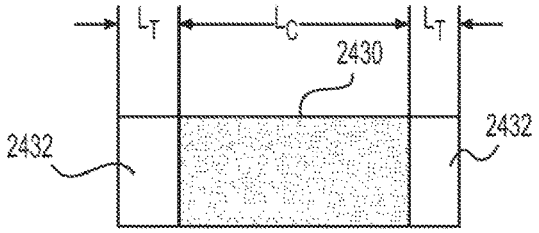
FIGS. 13A, 13B, and 13C show undersides of each strap of the handle used in the package shown in FIG. 11.
Figure 13B:
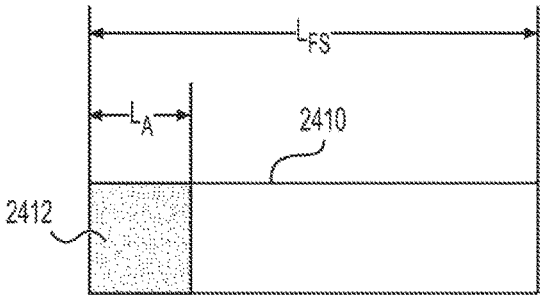
Figure 13C:
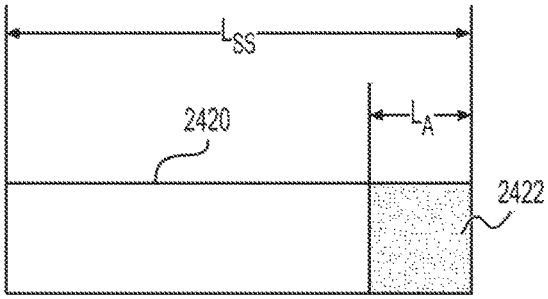
Figure 14:
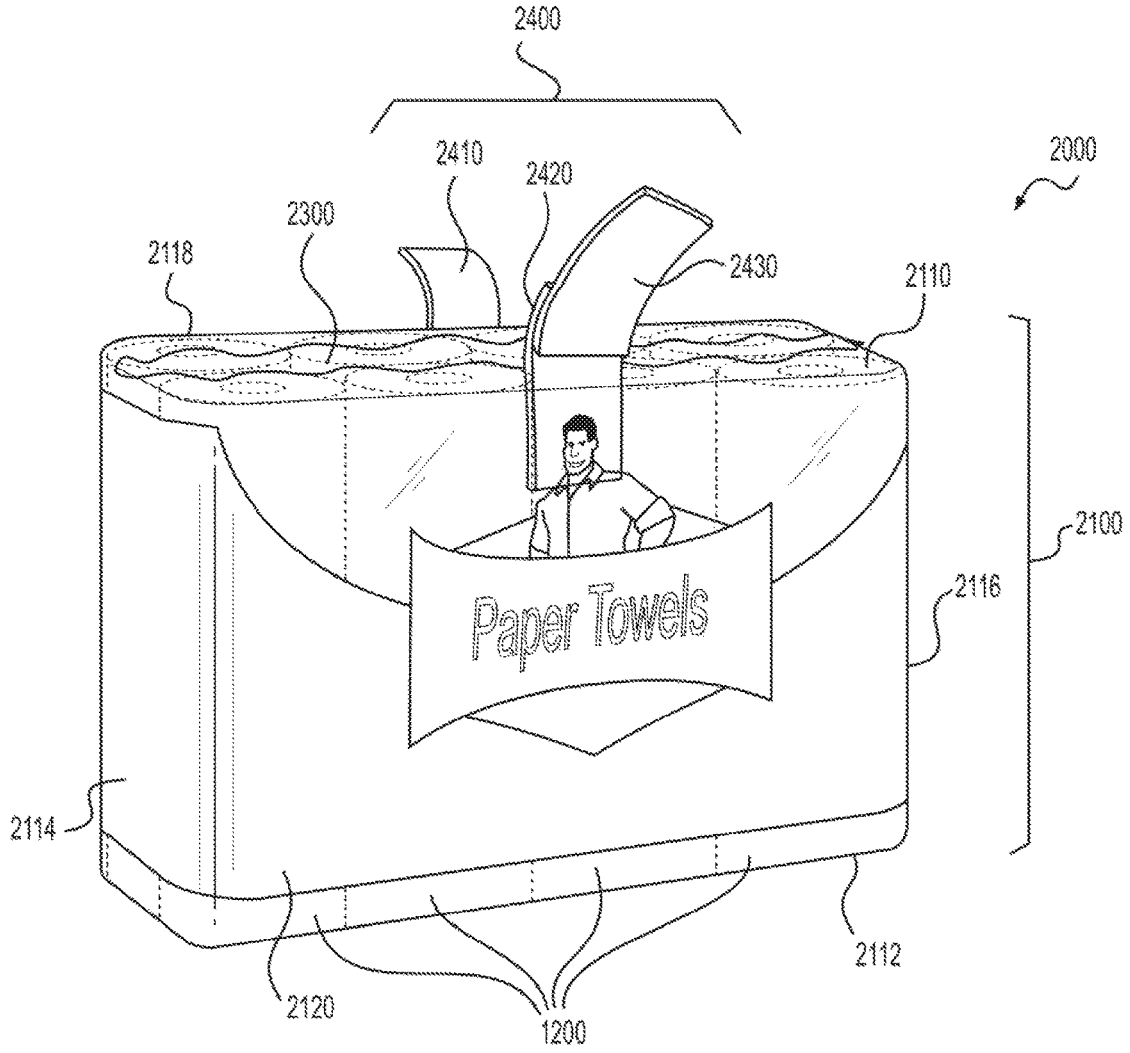
FIG. 14 shows the package of FIG. 11 in an open condition.

Similar to the first embodiment, the handle 2400 of the second embodiment may also include one or more tabs 2432 on the connecting strap 2430 to assist in detaching the connecting strap 2430 from either the first strap 2410 or the second strap 2420. The tabs 2432 may be positioned on either end of the connecting strap 2430, or both, as shown in FIGS. 12 and 13A. The handle 2400 may be opened by lifting the connecting strap 2430 in direction B to separate the connecting strap 2430 from the first strap 2410 or by lifting the connecting strap 2430 in direction C to separate the connecting strap 2430 from the second strap 2420. FIG. 14 shows the package 2000 of this embodiment in an open condition. The reclosable opening 2300 may then be opened to allow a user to remove one of the rolled paper products 1200 from the package 2000. The package 2000 may be closed by closing the reclosable opening 2300 and re-engaging the connecting strap 2430 with the either of the first strap 2410 or the second strap 2420 to return the package 2000 to its original condition. Similar to the package 1000 of the First Embodiment, the package 2000 may also be re-closed by using the connecting strap 2430 to seal the reclosable opening 2300.

Third Embodiment

Figure 15:
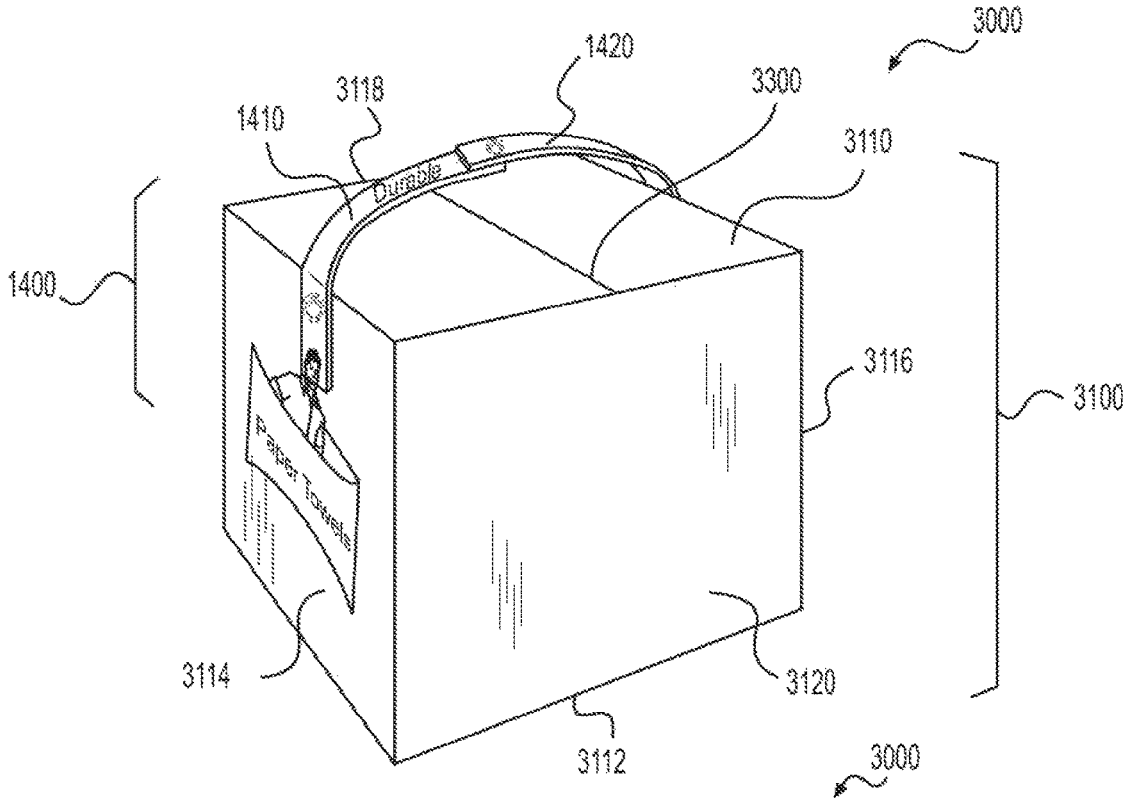
FIG. 15 is a third embodiment of the package of my invention.
Figure 16:
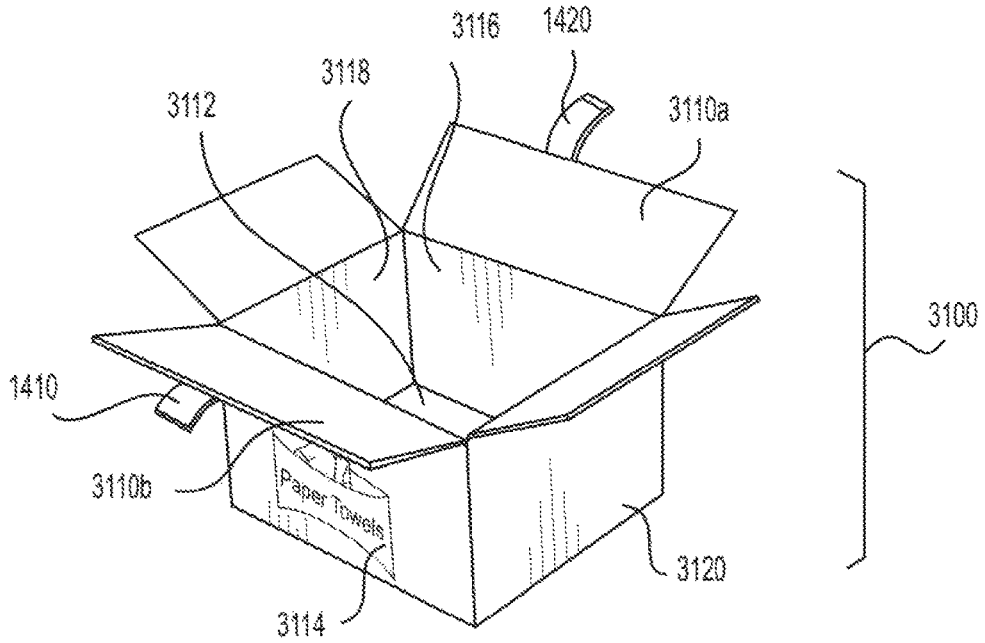
FIG. 16 shows the package of FIG. 15 in an open condition.

Those skilled in the art will recognize that my invention is not limited to flexible package bodies 1100, 2100. The handles 1400, 2400 of my invention may be suitability used on other package bodies such as a rigid package body 3100. FIGS. 15 and 16 show an exemplary third embodiment of my invention. The package 3000 includes a rigid package body 3100 having six faces, a top face 3110; a bottom face 3112; two end faces 3114, 3116; and two side faces 3118, 3120. The top face 3110 and bottom face, 3112 are opposite to one another. Similarly, the two end faces 3114, 3116 are opposite to one another, and the two side faces 3118, 3120 are opposite to one another. The rigid package body 3100 may be made of any suitable material known to those skilled in the art, including corrugated cardboard and solid fiber. As with the first two embodiments, the package 3000 of the third embodiment may have graphic and textual markings on the package 3000.

The package 3000 shown in FIGS. 15 and 16 has a reclosable opening 3300 on the top face 3110. In this embodiment, the reclosable opening 3300 is the top face 3110. The top face 3110 is separated into two sections, a first section 3110*a* and a second section 3110*b*. The first section 3110*a* is pivotably attached to an adjacent end face 3116 and the second section 3110*b* is pivotably attached to the other adjacent end face 3114. The two sections abut each other in the closed position shown in FIG. 15. FIG. 16 shows the package 3000 in an open condition with each section shown in an open position.

The package 3000 of the third embodiment is shown in FIGS. 15 and 16 with the handle 1400 described in the first embodiment. But, either the handle 1400, 2400 described in the first embodiment or the second embodiment may be used with the rigid package body 3100 described in this embodiment.

Other Embodiments

Those skilled in the art will recognize that the package body of my invention is not limited to a rectangular prism described in connection with the embodiments above. Either handle 1400, 2400 described in connection with the first embodiment or described in connection with the second embodiment may be used on package bodies having other geometries. Such examples are discussed below in more detail.

Figure 17:
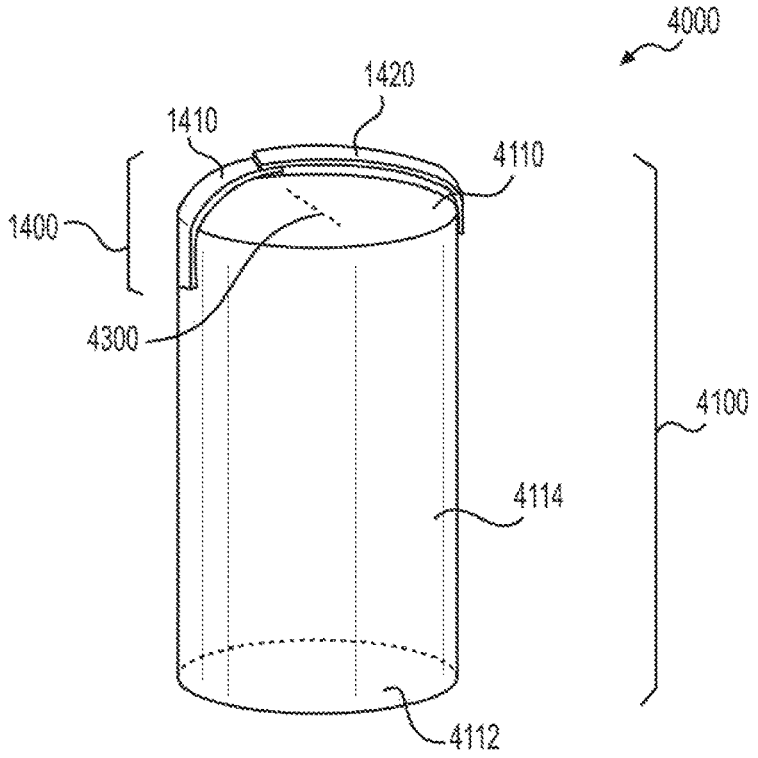
FIG. 17 is another embodiment of my invention having an alternate package body.
Figure 18:
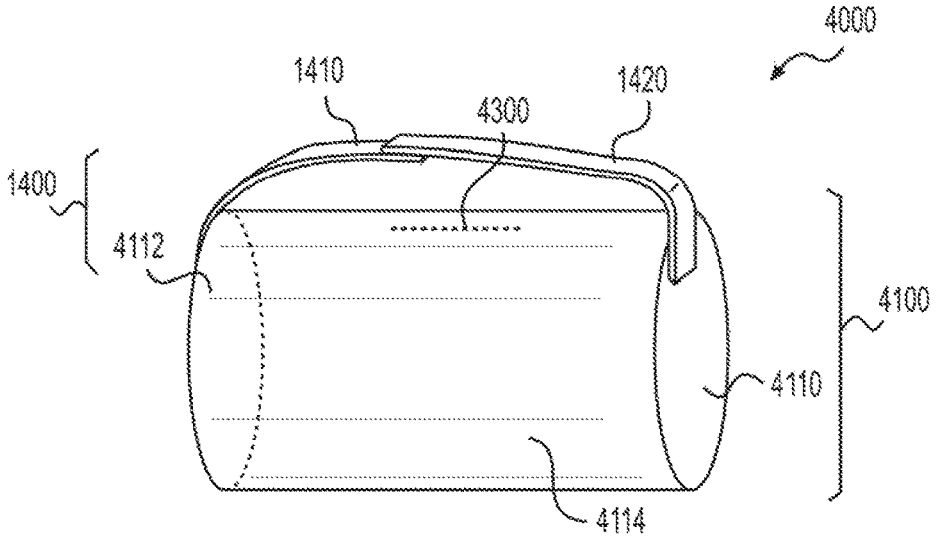
FIG. 18 shows an alternate handle location for the package shown in FIG. 17.

FIGS. 17 and 18 show alternate embodiments of the package 4000 of my invention in which the package body 4100 has a cylindrical shape, by way of example, using the handle 1400 described in connection with the first embodiment. Here, the package body 4100 has a first face 4110, a second face 4112, and a circumferential face 4114. As shown in FIG. 17, the reclosable opening 4300 is on the first face 4110. The first strap 1410 of the handle 1400 is attached to the circumferential face 4114 at a first position and the second strap 1420 is attached to the circumferential face 4114 at a second position. The first position and the second position are preferably diametrically opposite to each other. As shown in FIG. 18, the reclosable opening 4300 is on the circumferential face 4114 of the package body 4100. Here, the first strap 1410 is attached to the second face 4112 and the second strap 1420 is attached to the first face 4110.

Figure 19:
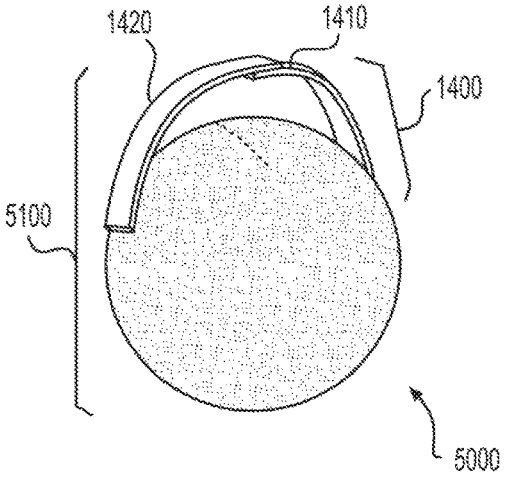
FIG. 19 is another embodiment of my invention having an alternate package body.
Figure 20:
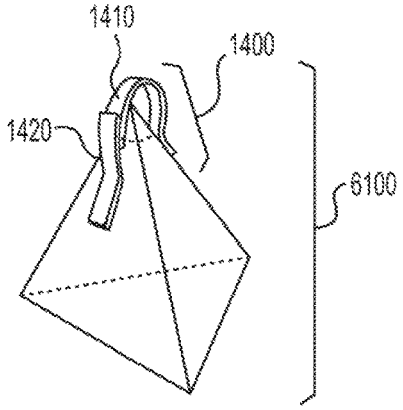
FIG. 20 is another embodiment of my invention having an alternate package body.
Figure 21:
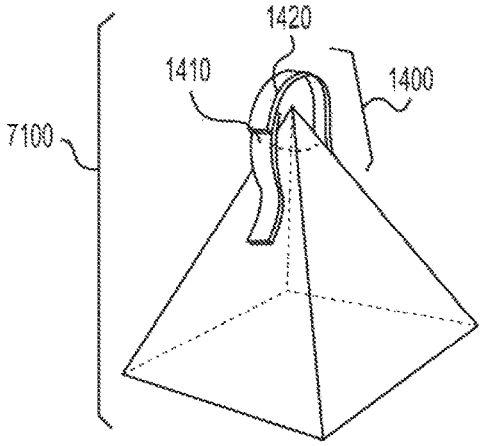
FIG. 21 is another embodiment of my invention having an alternate package body.
Figure 22:
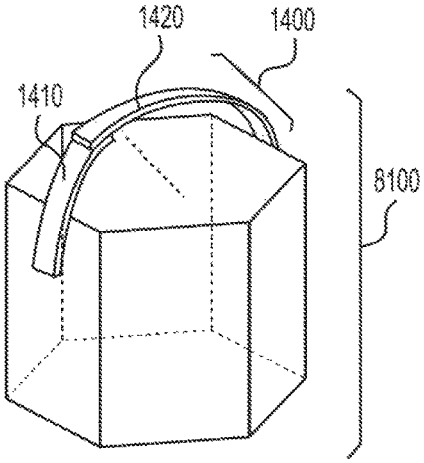
FIG. 22 is another embodiment of my invention having an alternate package body.

A package 5000 may have a package body 5100 with only one face, such as the spherical package body 5100 shown in FIG. 19. As shown in this figure, each of the first strap 1410 and the second strap 1420 is attached to the face of the package body 5100 at different positions. The attachment portion 1422 (FIG. 7A) of the second strap 1420 is disposed opposite to the attachment portion 1412 (FIG. 7B) of the first strap 1410.

Those skilled in the art will recognize that my invention is applicable to any other suitable package geometries. For example, the package body 6100, 7100, 8100 may be a triangular based pyramid shown in FIG. 20, a square based pyramid shown in FIG. 21, or a hexagonal prism shown in FIG. 22. Of course, other package geometries, although not shown, are contemplated within the realm of my invention. In FIGS. 17-22, the package bodies 4100, 5100, 6100, 7100, 8100 are shown with the handle 1400 described in the first embodiment. But, either the handle 1400, 2400 described in the first embodiment or the second embodiment may be used with these package bodies 4100, 5100, 6100, 7100, 8100.

While I have described my invention in terms of a multi-piece handle 1400, 2400, certain advantageous benefits may be achieved by implementing my invention using a handle comprising a single strap. The single strap may have two attachment portions to attach the strap to a package body. At least one of these attachment portions may utilize an adhesive that may be removed and reattached to the package body without tearing it. With such a handle, a reclosable opening (e.g., reclosable opening 1300, see FIG. 4) of the package body may be cinched closed using the handle.

Although I have described my invention in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention can be used as a package for consumer products, including paper products such as paper towels and bathroom tissue. Thus, the invention is applicable to the consumer products and paper products industry.

I claim:

1. A package for storing and carrying a product, the package comprising:

(a) a rigid package body for storing a product therein, the rigid package body having at least six faces and a reclosable opening on a face of the rigid package body to allow removal of the product; and (b) a handle, for carrying the package, being attached to the package body and positioned over the reclosable opening, the handle having:

(i) a first strap including a first end and a second end, the first end being attached to one face of the package body;

(ii) a second strap including a first end and a second end, the first end being attached to another face of the package body, the other face of the package body being opposite to the face that is attached to the first strap; and (iii) a connection portion on the second end of the second strap, the connection portion being detachably engageable with the second end of the first strap and comprising a pressure sensitive adhesive to detachably engage the second end of the first strap.

2. The package of claim 1, wherein the rigid package body is made of at least one of (i) corrugated cardboard and (ii) solid fiber.

3. The package of claim 1, wherein the reclosable opening is a resealable opening.

4. The package of claim 1, wherein the face with the reclosable opening includes at least two sections, each section having an open position and a closed position, and being pivotally attached to an adjacent face of the rigid package body, the at least two sections configured to abut each other in the closed position to form the reclosable opening.

5. The package of claim 1, wherein the handle is made of at least one of (i) plastic and (ii) paper.

6. The package of claim 5, wherein the handle includes a fiber reinforcement.

7. The package of claim 1, wherein the handle is made of at least one of (i) polyolefin, (ii) polyester, and (iii) polyamide.

8. The package of claim 1, wherein the handle is made of at least one of (i) polyethylene, (ii) polypropylene, (iii) nylon, (iv) polyvinyl chloride, and (v) polyvinylidene chloride.

9. The package of claim 1, wherein the first strap is attached to the package using a pressure sensitive adhesive.

10. The package of claim 1, wherein the second strap is attached to the package using a pressure sensitive adhesive.

11. The package of claim 1, wherein the rigid package body is a generally rectangular prism, one of the at least six faces is a first end, one of the at least six faces is a second end, the second end positioned opposite to the first end, and the other four faces of the at least six faces are generally rectangular in shape.

12. The package of claim 11, wherein the reclosable opening is located on one of the four faces having a generally rectangular shape, the first strap being attached to the first end, and the second strap being attached to the second end.

13. The package of claim 11, wherein the reclosable opening is located on one of the four faces having a generally rectangular shape, the first strap being attached another one of the four faces having a generally rectangular shape, and the second strap being attached to a third one of the four faces having a generally rectangular shape.

14. The package of claim 11, wherein the reclosable opening is located on the first end, the first strap being attached one of the four faces having a generally rectangular shape, and the second strap being attached to another one of the four faces having a generally rectangular shape.

15. The package of claim 1, wherein the connection portion has a length from about one inch to about twenty-four inches.

16. The package of claim 1, wherein the connection portion has a length from about two inches to about ten inches.

17. The package of claim 1, wherein the connection portion has a length from about three inches to about six inches.

18. The package of claim 1, further comprising a tab to assist in detaching the first strap from the second strap, the tab positioned on the second end of the second strap, proximate to the connection portion.

19. The package of claim 18, wherein the tab has a length from about a quarter of an inch to about one inch.

20. A package for storing and carrying a product, the package comprising:

(a) a rigid package body for storing a product therein, the rigid package body having at least six faces and a reclosable opening on a face of the rigid package body to allow removal of the product; and (b) a handle, for carrying the package, being attached to the package body and positioned over the reclosable opening, the handle having:

(i) a first strap including a first end and a second end, the first end being attached to one face of the package body;

(ii) a second strap including a first end and a second end, the first end being attached to another face of the package body, the other face of the package body being opposite to the face that is attached to the first strap;

(iii) a connection portion on the second end of the second strap, the connection portion being detachably engageable with the second end of the first strap; and (iv) a tab to assist in detaching the second strap from the first strap, the tab being positioned on the second end of the second strap, proximate to the connection portion.

21. The package of claim 20, wherein the rigid package body is made of at least one of (i) corrugated cardboard and (ii) solid fiber.

22. The package of claim 20, wherein the reclosable opening is a resealable opening.

23. The package of claim 20, wherein the face with the reclosable opening includes at least two sections, each section having an open position and a closed position, and being pivotally attached to an adjacent face of the rigid package body, the at least two sections configured to abut each other in the closed position to form the reclosable opening.

24. The package of claim 20, wherein the handle is made of at least one of (i) plastic and (ii) paper.

25. The package of claim 24, wherein the handle includes a fiber reinforcement.

26. The package of claim 20, wherein the handle is made of at least one of (i) polyolefin, (ii) polyester, and (iii) polyamide.

27. The package of claim 20, wherein the handle is made of at least one of (i) polyethylene, (ii) polypropylene, (iii) nylon, (iv) polyvinyl chloride, and (v) polyvinylidene chloride.

28. The package of claim 20, wherein the connection portion further comprises one of (i) a pressure sensitive adhesive and (ii) a hook and loop fastener to detachably engage the second end of the first strap.

29. The package of claim 20, wherein the first strap is attached to the package using a pressure sensitive adhesive.

30. The package of claim 20, wherein the second strap is attached to the package using a pressure sensitive adhesive.

31. The package of claim 20, wherein the rigid package body is a generally rectangular prism, one of the at least six faces is a first end, one of the at least six faces is a second end, the second end positioned opposite to the first end, and the other four faces of the at least six faces are generally rectangular in shape.

32. The package of claim 31, wherein the reclosable opening is located on one of the four faces having a generally rectangular shape, the first strap being attached to the first end, and the second strap being attached to the second end.

33. The package of claim 31, wherein the reclosable opening is located on one of the four faces having a generally rectangular shape, the first strap being attached another one of the four faces having a generally rectangular shape, and the second strap being attached to a third one of the four faces having a generally rectangular shape.

34. The package of claim 31, wherein the reclosable opening is located on the first end, the first strap being attached one of the four faces having a generally rectangular shape, and the second strap being attached to another one of the four faces having a generally rectangular shape.

35. The package of claim 20, wherein the connection portion has a length from about one inch to about twenty-four inches.

36. The package of claim 20, wherein the connection portion has a length from about two inches to about ten inches.

37. The package of claim 20, wherein the connection portion has a length from about three inches to about six inches.

38. The package of claim 20, wherein the tab has a length from about a quarter of an inch to about one inch.

* * * * *